US006091011A

United States Patent [19]

Simons et al.

[11] Patent Number: 6,091,011

[45] Date of Patent: Jul. 18, 2000

[54] MULTIPLE MUSICAL INSTRUMENT HOLDER

[75] Inventors: Richard Simons, Garfield; Andrzej Krol, Elmwood Park, both of N.J.

[73] Assignee: Latin Percussion, Inc., Garfield, N.J.

[21] Appl. No.: 09/237,688

[22] Filed: Jan. 26, 1999

[51] Int. Cl.[7] ..... G10D 13/02

[52] U.S. Cl. ..... 84/421; 84/411 R

[58] Field of Search ..... 84/411 R, 421, 84/327, 453; D17/22, 443, 496; 248/443, 496

[56] References Cited

U.S. PATENT DOCUMENTS

| | | | |
|---|---|---|---|
| 2,455,821 | 12/1948 | Stenger | 211/13 |
| 3,163,076 | 12/1964 | White | 84/419 |
| 3,433,115 | 3/1969 | Kjelstrom | 84/411 R |
| 3,529,799 | 9/1970 | Schaefer | 248/496 |
| 3,774,823 | 11/1973 | Hoellerich | 224/5 S |
| 4,112,807 | 9/1978 | Quibell | 84/411 R |
| 4,126,075 | 11/1978 | Kurosaki | 84/421 |
| 4,176,580 | 12/1979 | Gallegos | 84/327 |
| 4,387,839 | 6/1983 | Dranchak | 224/265 |
| 4,453,446 | 6/1984 | Hoshino | 84/421 |
| 4,878,414 | 11/1989 | Yamashita | 84/421 |
| 5,804,747 | 9/1998 | Chen | 84/327 |
| 5,895,874 | 4/1999 | Liao | 84/421 |

FOREIGN PATENT DOCUMENTS

| | | |
|---|---|---|
| 295 00 540 | 2/1995 | Germany . |
| 466632 | 6/1937 | United Kingdom . |
| 2086120 | 5/1982 | United Kingdom . |
| 2257457 | 1/1993 | United Kingdom . |

OTHER PUBLICATIONS

Latin Percussion Catalog, pp. 4 and 10, Jan. 1975.

*Primary Examiner*—Stanley J. Witkowski
*Assistant Examiner*—Kim Lockett
*Attorney, Agent, or Firm*—Ohlandt, Greeley, Ruggiero & Perle, L.L.P.

[57] ABSTRACT

A multiple musical instrument holder with a mounting plate attached to a stand. Each musical instrument is connected to a mounting member. The mounting member frictionally engages the mounting plate. Optionally, a support bracket can be attached to the stand. The support bracket contacts each instrument mounted to the stand, thus, providing stability to the mounted instruments and to the holder.

19 Claims, 4 Drawing Sheets

FIG. 3
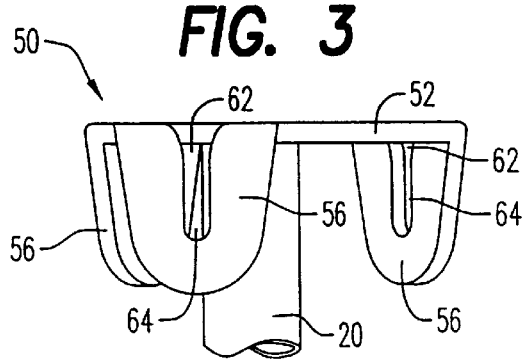
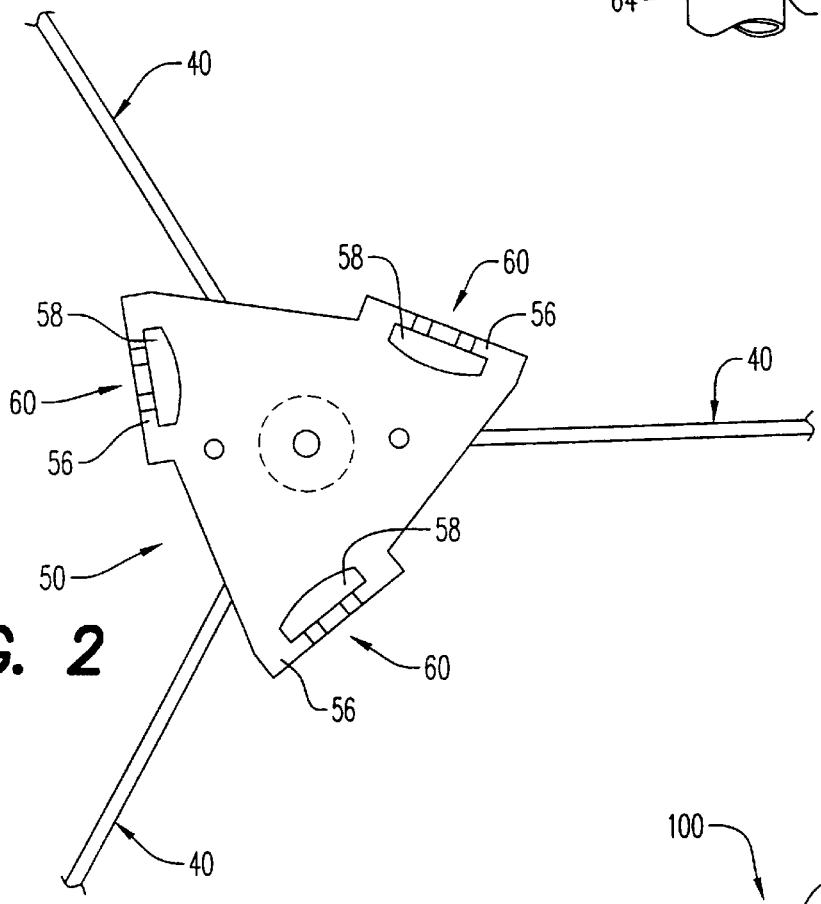
FIG. 2
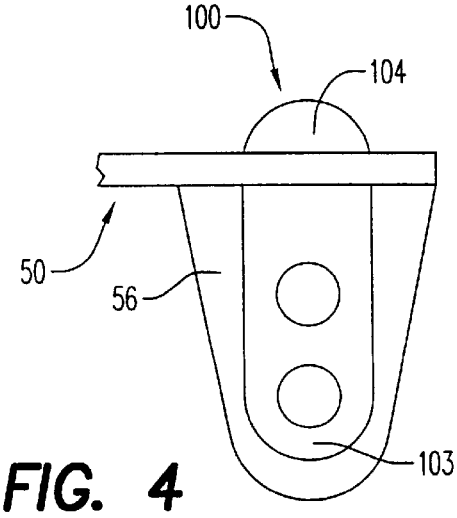
FIG. 4

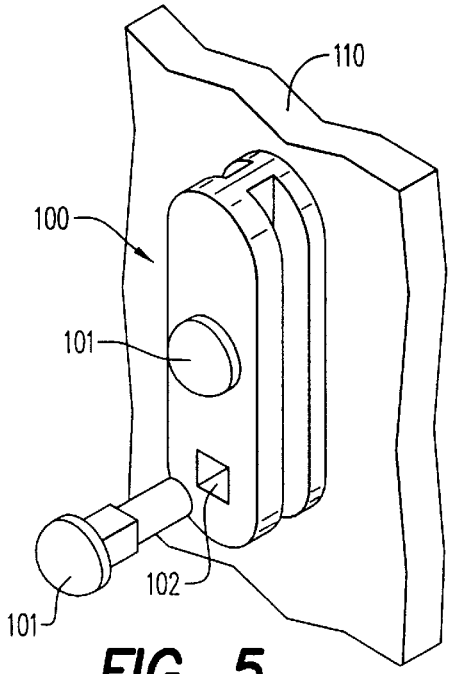
FIG. 5
FIG. 6
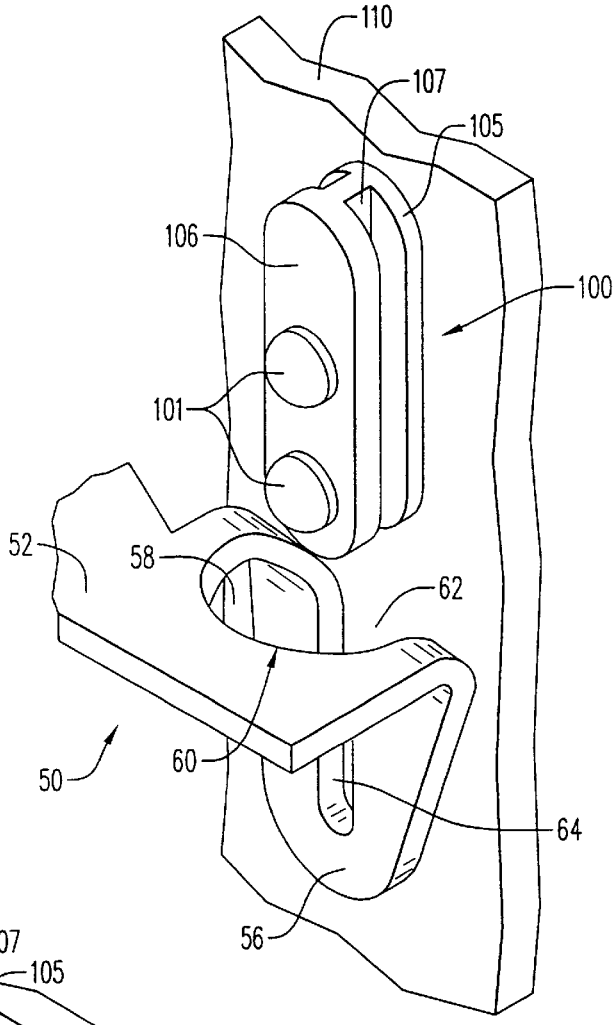
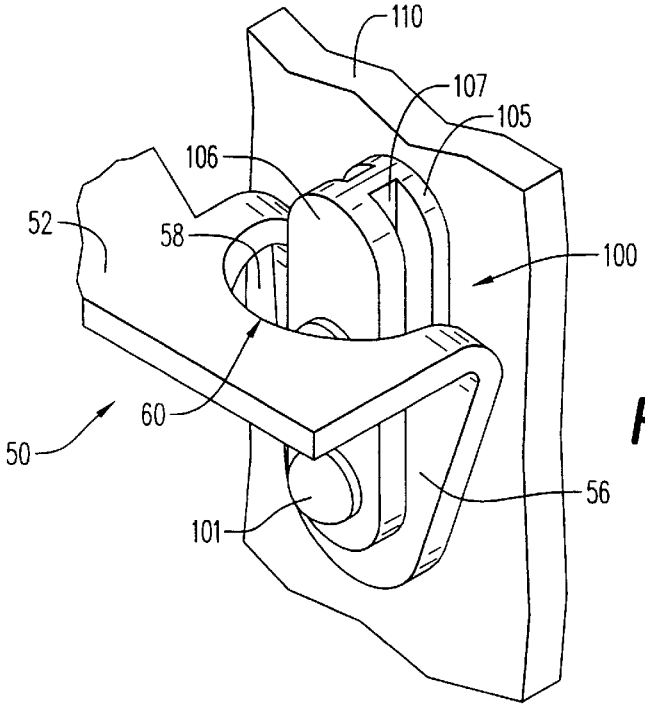
FIG. 7

MULTIPLE MUSICAL INSTRUMENT HOLDER

BACKGROUND OF THE INVENTION

1. Field of the Invention

The present invention relates to musical instrument holders. More particularly, the present invention relates to a holder for mounting multiple percussion instruments, such as conga and other drums.

For ease of play, musicians typically mount musical instruments on holders. Each holder is usually a separate assembly without connection to other holders. This arrangement creates several problems.

First, the amount of area lost, due to the numerous holders, reduces the musician's flexibility especially with respect to his total instrument assembly and his ability to reach each instrument. Clearly, the numerous holders also take up a large amount of space on a stage or in a studio. Thus, the musician has to make due with fewer instruments than he may desire for a particular musical application or the ability to work with each instrument selected is impeded due to the lack of space. Also, the musician will impinge on space needed by other musicians playing on the stage or in the studio.

Second, the several holders do not work together to provide stability for each other. Also, playing an instrument, e.g. a conga or other drum, often requires that significant force be applied to the instrument and its holder. Without stability, a musician faces a substantial risk that the instrument and holder will fall over while the instrument is being played.

A solution to the first problem is to mount several instruments on one holder. However, there will be a problem of stability especially if one instrument is removed. There is also a problem that a single holder for multiple instruments must function so as not to affect the tone of the mounted instruments. To date, no holder can simultaneously mount more than two large musical hand drums such as congas.

Regardless of the number of instruments actually mounted to the holder, conventional holders require dismounting of all instruments and a large degree of disassembly for storage and travel. In addition, the instruments are often several pieces of a much larger total instrument assembly that must also be disassembled. Also, the instrument assembly may affect the ability of the musician to have ready access to other instruments on the stand.

2. Description of the Prior Art

An example of a musical drum stand is shown in U.S. Pat. No. 4,126,075 issued on Nov. 21, 1978 to Kurosaki. This patent shows holding a pair of drums in set positions. An upper mounting assembly is placed on the drum. The upper mounting assembly is a receptacle designed to accommodate a lower mounting assembly, which is a horizontal bar on the stand. After permanently attaching the upper mounting assembly to the body of the drum with screws, the drum is simply set on the stand and kept in place by the interaction of the upper mounting assembly and the lower mounting assembly. A vibration damper may be sandwiched between the body of the drum and the mounting device so that vibration is not transferred from the drum to the stand. This vibration damper aids in the stability of the stand. This patent envisions two drums mounted in position 180° from each other. Three large musical drums cannot be mounted to this stand. More importantly, this stand cannot be adapted to hold more than two large musical drums.

Another musical drum stand is shown in U.S. Pat. No. 4,112,807, which issued on Sep. 12, 1978, to Quibell. This stand is a rectangular frame with several supporting legs extending out from the bottom of the rectangular frame. The frame is large and heavy enough so that the seat mounted on the frame can support the percussion musician while playing the mounted conga drums. Two conga drums are mounted on the frame by a band around the body of the conga drum. The band on the congas will create pressure that could change the desired acoustic properties of the congas. This stand is large, cumbersome, and permits only two congas be placed on the stand.

An example of a musical instrument holder for musical drum stands is shown in U.S. Pat. No. 4,453,446, which issued on Jun. 12, 1984 to Hoshino. U.S. Pat. No. 4,453,446 is directed to a holder for supporting a pair of tom-toms. This holder has a two L-shaped arms contained within respective horizontal mounts. Each L-shaped arm supports a tom-tom on one end and has a hinge ball at the other end. The hinge ball is rotatably journaled inside the horizontal mount. The two L-shaped arms are adjusted to the preferred position, then wing-nuts are tightened down on the hinge balls to hold the two L-shaped arm in place.

A second example of a musical instrument holder for musical drum stands is shown in U.S. Pat. No. 5,804,747, which issued on Sep. 8, 1998 to Chen. U.S. Pat. No. 5,804,747 also has two L-shaped arms secured by wing-nuts within horizontal mounts. The hinge ball is rotatably journaled inside the horizontal mount. In addition, the horizontal mount surrounding one L-shaped arm may be annularly moved so that the angle between the two horizontal mounts can be changed. Several wing-nuts must be loosened to adjust the position of the L-shaped arms and then tightened before playing.

These prior art patents are cumbersome, and do not address the issue of stability for the stand itself or the mounted drums.

Accordingly, a need exists for a musical instrument holder that easily mounts multiple musical instruments while maintaining adequate stability, even when less than the total possible number of musical instruments are mounted. A need also exists for such a holder that does not affect the acoustical sound of the instruments.

SUMMARY OF THE INVENTION

It is an object of the present invention to provide a holder to mount, with ease, two or three musical instruments, i.e. congas and other large musical hand drums, to a single holder while still maintaining adequate stability.

It is another object of the present invention to provide such a holder that maintains adequate stability when only two musical instruments are mounted on the holder.

It is still another object of the present invention to provide such a holder that has an adjustable mounting brace between the holder and the mounted musical instruments for supplemental support for the mounted musical instruments and stability for the holder.

It is a further object of the present invention to provide such a holder that is readily connectable to a mounting member secured to the musical instrument.

It is still a further object of the present invention to provide such a holder with such a mounting member secured to a musical instrument that has a profile that minimizes the distance between adjacent musical instruments mounted on the holder, yet provides sufficient distance so that the instruments do not interfere with each other.

Accordingly, the present invention provides a multiple musical drum holder in which the holder includes a mounting plate with multiple mounting slots within which drums with complimentary members are frictionally held. A mounting member is placed on each drum to secure the drum to the holder.

BRIEF DESCRIPTION OF THE DRAWINGS

FIG. 2 is a top plan view of the mounting plate of the holder of FIG. 1;

FIG. 3 is a side perspective view of the mounting plate of FIG. 1;

FIG. 4 is a side plan view of a mounting member being secured to a drum;

FIG. 5 is a side perspective view of the mounting member of FIG. 4 being connected to the mounting plate of FIG. 1;

FIG. 6 is a side perspective view showing the mounting member of FIG. 4 just before it engages the mounting plate of FIG. 1;

FIG. 7 is a side perspective view showing the mounting member of FIG. 4 engaged with the mounting plate of FIG. 1.

DESCRIPTION OF THE INVENTION

Figure 1:
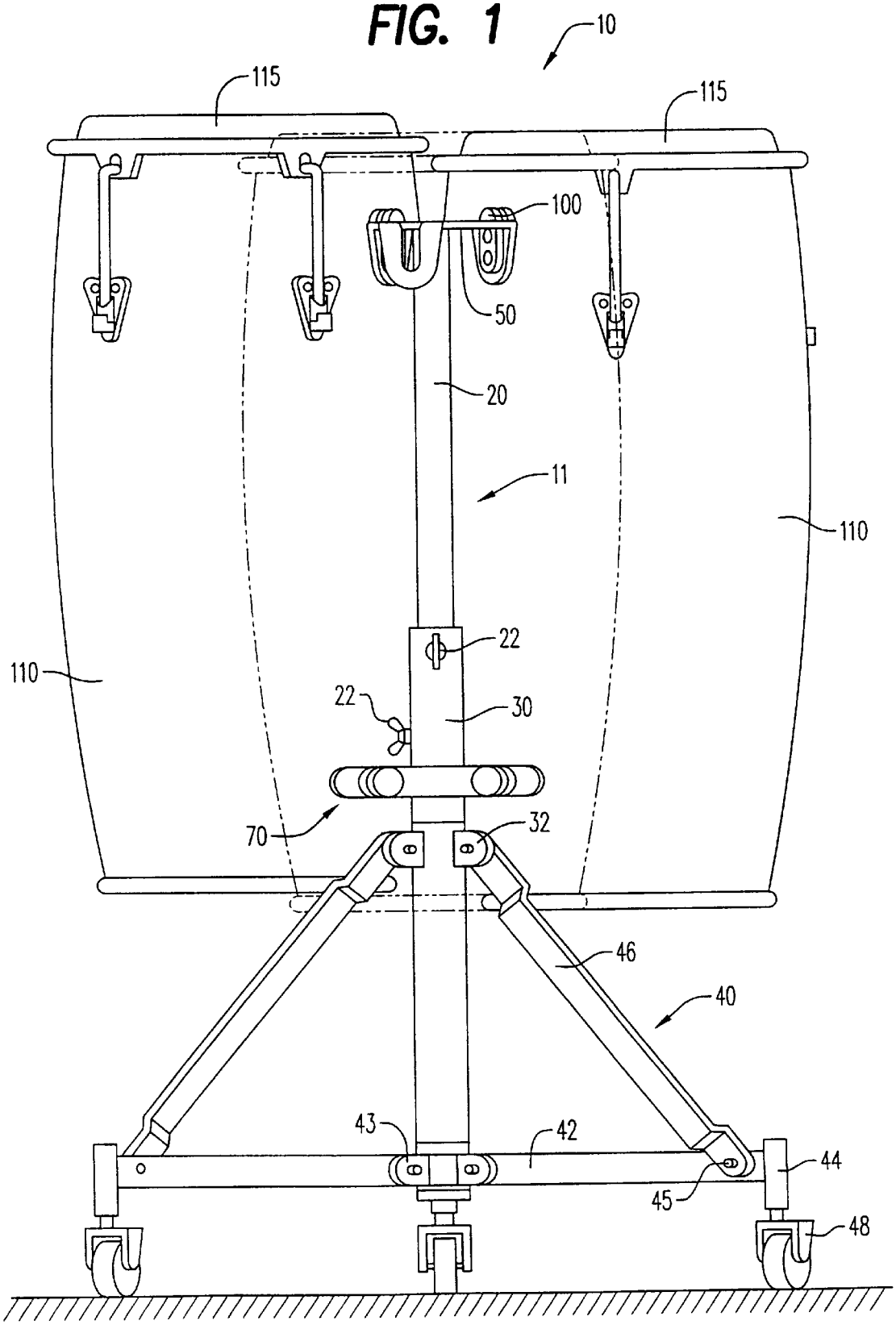
FIG. 1 is a side perspective view of drums held by a holder of the present invention.

Referring to the figures and, in particular, FIG. 1, there is provided a preferred embodiment of the multiple musical instrument holder generally represented by reference numeral 10. The holder 10 includes a holder body 11 comprising a first pole or tube 20, a second pole or tube 30 that is adapted to telescopically receive therein the first tube, and a plurality of legs 40 connected to the second pole to secure the holder body 11 in an upright position. The second pole 30 has secured to the exterior thereof a pin and bracket 32 for connecting the plurality of legs 40 the second pole.

The first and second poles 20, 30 are preferably hollow tubes. These poles are preferably made of metal, stainless steel or other material that provides rigidity, but is not too heavy.

The first pole 20 may be telescopically adjusted or raised, as much as desired, out of second pole 30 and secured in that position by conventional means, such as, for example, wing-nuts 22. The wing nuts 22 are placed through an aperture in the wall of second pole 30 and, when tightened, frictionally engage first pole 20, preferably the exterior surface of the first pole. The number of wing nuts 22 and holes should be as many as possible needed so that when first pole 20 is raised out of second pole 30 and the musical instruments are mounted on holder 10 and being played, the first pole does not shift or slide in the second pole. Preferably, the wing nuts 22 and holes are staggered along second pole 30 as shown. Two or more wing nuts 22 and holes are needed, however it is preferred that only two, or possibly three, wing nuts and holes be used.

Alternatively, first pole 20 secured in any desired position out of second pole 30 by other conventional means, such as bolts or clamps.

The plurality of legs 40 include a plurality of leg members 42 and a plurality of brace members 46. The plurality of leg members 42 are secured to second pole 30 by pin and bracket 43, and secured to the plurality of brace members 46 by pin 45. The plurality of brace members 46 are secured to second pole 30 by brackets 32. At the distal end of each leg member 42 is a holder 44 that is adapted to receive the shank of a caster 48. Casters 48 permit holder 10 to be readily moved by rolling from one location to the other.

Brackets 32 are conventional brackets, as are brackets 43, that permit brace members 46 to rotate about brackets 32. Likewise, pin 45 permits brace members 46 to rotate with respect to legs 42. Accordingly, brackets 32, 43 and pins 45 permit brace members 46 and legs 42 to be folded into an elongated structure thereby making the plurality of legs or stand 40 adapted to be readily carried and stored.

At the top of first pole 20 is removably or permanently secured thereto a mounting bracket or plate 50. As shown in FIGS. 2 and 3, mounting bracket 50 has a top 52 that is basically triangular in shape, with three bosses 56 depending downward therefrom. As shown in FIG. 3, each boss 56 is elongated with a slot 60 therein. Preferably, slot 60 has a V shape section 62 starting from top 52 with the apex of the V terminating into a narrower elongated section 64. The V shape section 62 is adapted to facilitate the connection of a mounting member 100 shown is FIG. 4 to holder 10.

The top of each boss 56 has an open end 58 that extends slightly toward the center of mounting plate 50 in order to more easily accommodate and guide mounting member 100 into slot 60. The boss 56 points slightly inward towards first pole 20 so mounting member 100 engages respective mounting slot 60 at an angle that places the centerline of a drum 110 parallel to the centerline of holder 10. When the centerline of drum 110 is parallel to the centerline of holder 10, a head 115 of drum 110, shown in FIG. 1, is parallel to the floor, which is the preferred orientation for the drum heads. The preferred embodiment may hold up to three drums 110 at one time and the distance between adjacent drums will be minimized, yet the drums will not come in contact with one another.

The bosses 56 are positioned equidistant about top 52 and oriented relative to legs 40 so that the mounting slot in each boss is positioned in a vertical plane between an adjacent pair of legs. In this orientation, when each drum 110 is mounted to plate 50, each drum 110 hangs between two adjacent legs. By this orientation of legs 40 and the positioning of bosses 56 around mounting plate 50, first, the center of gravity of the holder is such that the holder has stability with two or three drums 110 mounted on the holder, and second, the distance between adjacent mounted drums is minimized.

Mounting member 100 is engagable within slot 60 and removably or permanently secured to drum 110. Preferably, mounting member 100 is secured to a drum 110, as shown in FIG. 5, by bolts 101 that pass through holes 102 in the mounting member. The number of bolts and holes should be as many as needed so that the mounting member does not shift or rotate on drum 110 even when mounting member 100 is engaged within slot 60 and the drum 110 is secured to mounting member 100 and being played. Two or more bolts 101 and holes 102 are needed, however it is preferred that two or three bolts and holes be used.

As seen in FIG. 5, mounting member 100 is longer vertically than it is wide horizontally. Preferably, mounting member 100 has an oval shape. The holes 102 are vertically off center resulting in a short vertical end, generally denoted as 103, and a longer vertical end, generally denoted as 104, in FIG. 4. The mounting member 100 may be secured to drum 110 with either shorter vertical end 103 or longer vertical end 104 pointing towards the ground. The height of head 115 of drum 110 when mounted on holder 10 is changed depending on which vertical end is pointing toward the ground.

As shown in FIG. 6, mounting member 100 has a back plate 105 that is adapted to be secured to drum 110, and a front plate 106. The front plate 106 and back plate 105 are spaced apart by a recessed member 107. As shown in FIG. 7, back plate 105 and front plate 106 are received at slot 60. Slot 60 is wide enough to accommodate recessed member 107 of mounting member 100. Recessed member 107 is thick enough to allow boss 56 to fit between back plate 105 and front plate 106.

Figure 8:
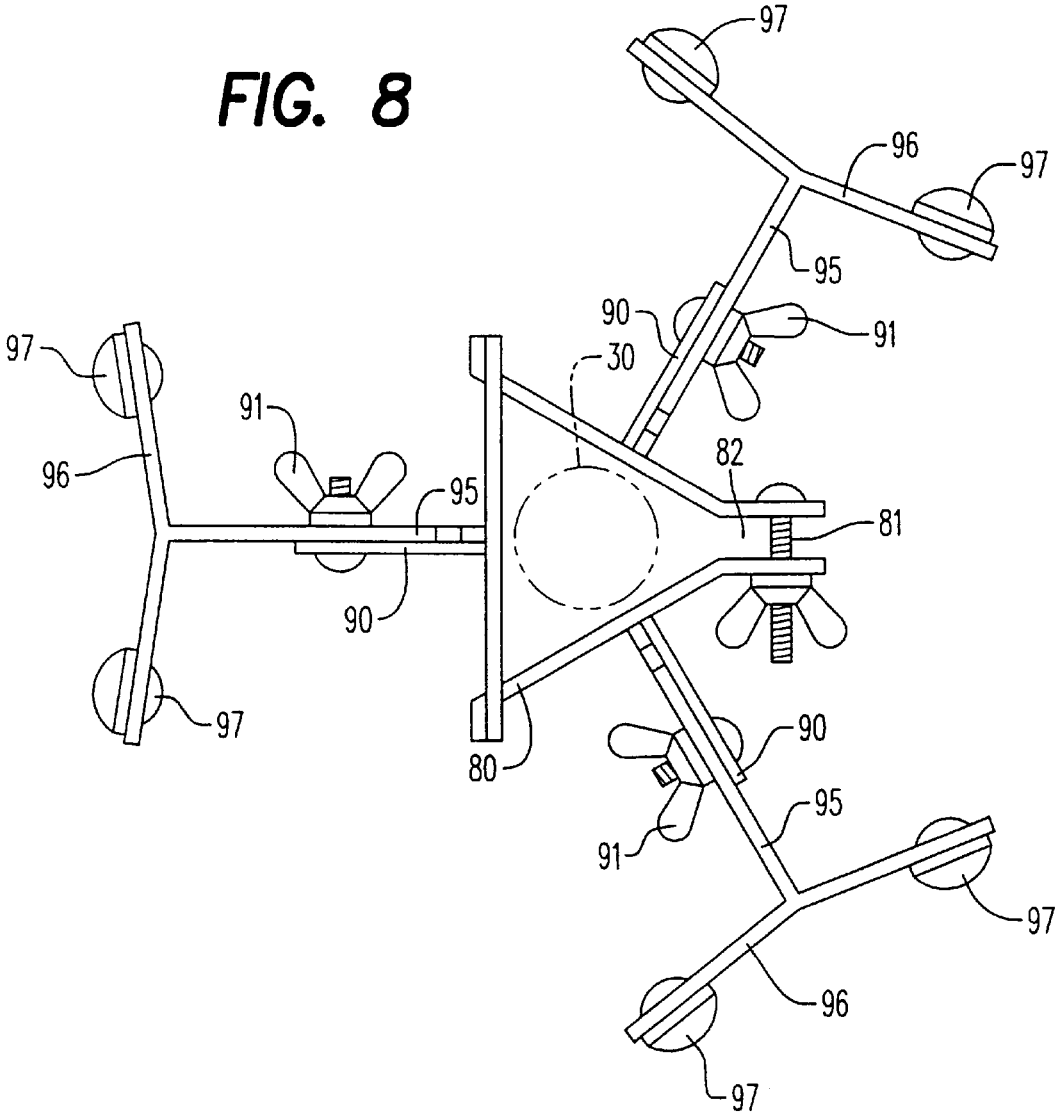
FIG. 8 is a top plan view of a brace member according to the present invention.

Referring to FIG. 1, around the circumference of second pole 30 is removably or permanently secured thereto a brace 70 for mounted drum 110. As shown in FIG. 8, brace 70 is secured around second pole 30 by triangular clamp 80 open at one corner 82. Clamp 80 is cinched around second pole 30 by means of a bolt 81 that closes corner 82. Alternatively, the brace 70 may be secured to second pole 30 or first pole 20 by conventional devices, such as a vise, screws, or carriage bolts.

Clamp 80 has a plurality of support arms 90 radially extending therefrom. Brace arms 95 extend in parallel from support arms 90. The brace arms 95 may be telescopically adjusted or extended, as much as desired, out from support arms 90 and are secured in that position by conventional means, such as, for example, wing nuts 91. Wing nuts are placed through respective apertures in support arms 90 and brace arms 95 and, when tightened, frictionally engage the support arms and brace arms. The number of wing nuts 91 should be as many as needed so that brace arm 95 does not shift or slide relative to support arm 90 when the brace arm is extended out from the support arm and the musical instruments are mounted on holder 10 and being played.

Preferably, there are as many brace arms 95 as there are slots 60. Fixed at the outward end of each brace arm 95 is a cross arm 96. At the distal or free end of each cross arm 96 is at least one bumper 97 that is mounted through an respective aperture in the cross arm. Preferably, when brace 70 is in use, brace arm 95 is adjusted to place the bumpers 97 in contact with the side of the drum 110. Preferably, bumpers 97 are made of rubber.

Various modifications may be made as will be apparent to those skilled in the art. Thus, it will be obvious to one of ordinary skill in the art that the foregoing description and drawings are merely illustrative of a certain preferred embodiment of the present invention, and that various obvious modifications can be made to these embodiments in accordance with the spirit and scope of the appended claims.

We claim:

1. A multiple musical instrument holder comprising:

a mounting plate having two or more mounting slots, a top, and a plurality of bosses each depending downward from said top;

said mounting plate being connected to a holder body, wherein said two or more mounting slots are positioned on said mounting plate relative to said holder body so that said holder body maintains a stable center of gravity when two or more musical instruments are mounted on said mounting plate.

2. The holder of claim 1, wherein said top has a triangular shape.

3. The holder of claim 1, wherein said mounting plate has three mounting slots.

4. The holder of claim 3, wherein said three mounting slots are positioned equidistant from each other, and wherein said holder body has three or more support legs, each one of said mounting slots being oriented in a vertical plane between adjacent support legs so that said holder body maintains a stable center of gravity when two or three musical instruments are mounted on said mounting plate.

5. The holder of claim 1, wherein each one of said three or more mounting slots is in a separate one of said plurality of bosses.

6. The holder of claim 1, wherein said plurality of bosses are angled toward said holder body so that a centerline of said musical instruments mounted on said holder will be parallel to a centerline of said holder body.

7. The holder of claim 1, further comprising:

means for bracing a mounted musical instrument, said means for bracing including a plurality of bracing arms, wherein said bracing arms are attached to said holder body, said bracing arms extending radially out from said holder body and placed flush against the respective side of said mounted musical instrument, whereby said mounted musical instrument is stabilized by said means for bracing.

8. The holder of claim 1, wherein said holder body includes a pole, and wherein said mounting plate is connected to said pole.

9. The holder of claim 1, wherein said holder body includes a first pole and a second pole, and wherein said mounting plate is connected to an upper portion of said first pole, said second pole being adapted to telescopically receive a lower portion of said first pole.

10. The holder of claim 9, wherein said holder body has a plurality of outward extending legs, and wherein each of said mounting slots is positioned in a vertical plane that is between an adjacent pair of said plurality of legs.

11. A multiple musical instrument holder comprising:

a holder body having a plurality of legs;

a mounting plate being connected to said holder body, said mounting plate having a top, and a plurality of bosses defining respective mounting slots, said mounting slots being positioned on said mounting plate relative to said holder body so that said holder body maintains a stable center of gravity when two or more musical instruments are mounted on said mounting plate; and a plurality of mounting members, each mounting member being connected to a musical instrument, wherein said mounting member is adapted to engage one of said mounting slots.

12. The holder of claim 11, wherein said musical instrument is a drum.

13. The holder of claim 11, wherein said plurality of bosses each depend downward from said top.

14. The holder of claim 11, wherein each one of said two or more mounting slots is in a separate one of said plurality of bosses.

15. The holder of claim 13, wherein said plurality of bosses are angled toward said holder body so that a centerline of one of said musical instruments mounted on said holder will be parallel to a centerline of said holder body.

16. The holder of claim 11, wherein said plurality of mounting members are each connected to said musical instruments at a point on said mounting member that is vertically off center.

17. The holder of claim 11, wherein one of said plurality of mounting members has a front plate and a back plate with said front and back plates being spaced apart by a recess, said back plate being mounted against said musical instrument, whereby one of said mounting slots is adapted to fit between said front plate and said back plate.

18. The holder of claim 17, wherein one of said mounting slots has an open end and a receptacle end, said open end being adapted to accommodate said mounting member and guide said mounting member into said receptacle end, said receptacle end having substantially parallel side walls, said side walls adapted to fit between said front plate and said back plate of said mounting member and frictionally engage said recess of said mounting member.

19. The holder of claim 7, wherein said bracing arm is T-shaped with a radially extending member and a cross member, whereby one end of said radially extending member is attached to said holder body and on the opposite end of said radially extending member is fixed with said cross member, said cross member placed flush against the side of a musical instrument, whereby the instrument is stabilized by said means for bracing.

* * * * *